US008531347B2

(12) United States Patent
Kirby et al.

(10) Patent No.: US 8,531,347 B2
(45) Date of Patent: Sep. 10, 2013

(54) NONCONDUCTIVE ANTENNA MOUNT

(75) Inventors: Morgan H. Kirby, Palmer Lake, CO (US); Tina Zhang, Parker, CO (US); David Lettkeman, Parker, CO (US)

(73) Assignees: EchoStar Technologies L.L.C., Englewood, CO (US); DISH Network L.L.C., Englewood, CO (US)

( * ) Notice: Subject to any disclaimer, the term of this patent is extended or adjusted under 35 U.S.C. 154(b) by 848 days.

(21) Appl. No.: 12/535,637

(22) Filed: Aug. 4, 2009

(65) Prior Publication Data

US 2011/0032172 A1 Feb. 10, 2011

(51) Int. Cl.
*H01Q 1/12* (2006.01)

(52) U.S. Cl.
USPC ..... 343/878; 343/892

(58) Field of Classification Search
USPC .... 343/878, 882, 890, 892, 874; 248/346.01, 248/165
See application file for complete search history.

(56) References Cited

U.S. PATENT DOCUMENTS

| | | | | |
|---|---|---|---|---|
| 4,595,165 | A | 6/1986 | Klingensmith et al. | |
| 5,526,010 | A | 6/1996 | Plunk | |
| 5,604,508 | A | 2/1997 | Atkinson | |
| 5,933,123 | A * | 8/1999 | Kaul | 343/879 |
| 6,037,913 | A * | 3/2000 | Johnson | 343/882 |
| 6,195,066 | B1 | 2/2001 | Pegues, Jr. et al. | |
| 6,276,649 | B1 * | 8/2001 | Kruse | 248/346.01 |
| 6,682,029 | B1 * | 1/2004 | Dierkes | 248/165 |
| 6,734,830 | B1 | 5/2004 | Bickham | |
| 6,873,304 | B1 | 3/2005 | Malhotra | |
| 6,942,189 | B2 | 9/2005 | Capozzi et al. | |
| 7,027,006 | B2 | 4/2006 | Holle | |
| 7,057,575 | B2 * | 6/2006 | Malhotra | 343/890 |
| RE39,661 | E | 5/2007 | Pegues, Jr. et al. | |
| 7,253,785 | B2 | 8/2007 | Holle | |
| 7,385,564 | B2 * | 6/2008 | Zihlman | 343/878 |
| 7,460,081 | B2 | 12/2008 | Holle | |
| 2009/0231224 | A1 * | 9/2009 | Felstead et al. | 343/766 |

* cited by examiner

*Primary Examiner* — Robert Karacsony
*Assistant Examiner* — Hasan Islam
(74) *Attorney, Agent, or Firm* — Lowe Graham Jones PLLC

(57) ABSTRACT

An antenna mount is disclosed. The antenna mount includes a mast and a foot that are substantially free of electrically conductive elements. The mast has a first end having a circular cross-section configured to be received by a mounting bracket of a satellite dish having a circular interior cross-section. The foot is configured to be secured to a stationary mounting surface and to be pivotally attached to a second end of the mast.

20 Claims, 4 Drawing Sheets

NONCONDUCTIVE ANTENNA MOUNT

BACKGROUND

With the introduction of direct-to-home satellite broadcast television systems, such as Direct Broadcast Satellite (DBS) systems, a multitude of television programs, audio channels, and the like previously unknown with terrestrial ("over-the-air") broadcast systems was made accessible to millions of potential subscribers. One aspect of such systems that allows such wide accessibility is the use of a small (e.g., less than one meter in diameter) and inexpensive satellite antenna, or "dish". To effectively employ such an antenna, a subscriber merely provides direct line-of-sight between the dish and the satellites of interest, and supplies a stable mounting platform or base to which the antenna is mounted, such as the exterior of the subscriber's home. The latter requirement helps prevent the antenna from becoming misaligned or misdirected as the result of strong winds or other meteorological conditions, which may cause disruption of the satellite signal carrying the programming.

While the limited size of the antenna has resulted in a large potential subscriber base, significant numbers of potential users remain substantially incapable of deploying a satellite antenna due to the environment surrounding their home. For example, multi-dwelling units (MDUs), such as apartment buildings, condominiums, and townhouses, are often associated with strict rules or covenants regarding private use of the common areas and the building exteriors.

BRIEF DESCRIPTION OF THE DRAWINGS

Many aspects of the present disclosure may be better understood with reference to the following drawings. The components in the drawings are not necessarily depicted to scale, as emphasis is instead placed upon clear illustration of the principles of the disclosure. Moreover, in the drawings, like reference numerals designate corresponding parts throughout the several views. Also, while several embodiments are described in connection with these drawings, the disclosure is not limited to the embodiments disclosed herein. On the contrary, the intent is to cover all alternatives, modifications, and equivalents.

DETAILED DESCRIPTION

The enclosed drawings and the following description depict specific embodiments of the invention to teach those skilled in the art how to make and use the best mode of the invention. For the purpose of teaching inventive principles, some conventional aspects have been simplified or omitted. Those skilled in the art will appreciate variations of these embodiments that fall within the scope of the invention. Those skilled in the art will also appreciate that the features described below can be combined in various ways to form multiple embodiments of the invention. As a result, the invention is not limited to the specific embodiments described below, but only by the claims and their equivalents.

In addition, directional references employed below, such as "up", "down", "left", "right", "back", "front", "upper", "lower", and so on, are provided to relate various aspects of the structures to each other, and are not intended to limit the embodiments disclosed herein to a particular orientation with respect to their surrounding environment.

Figure 1:
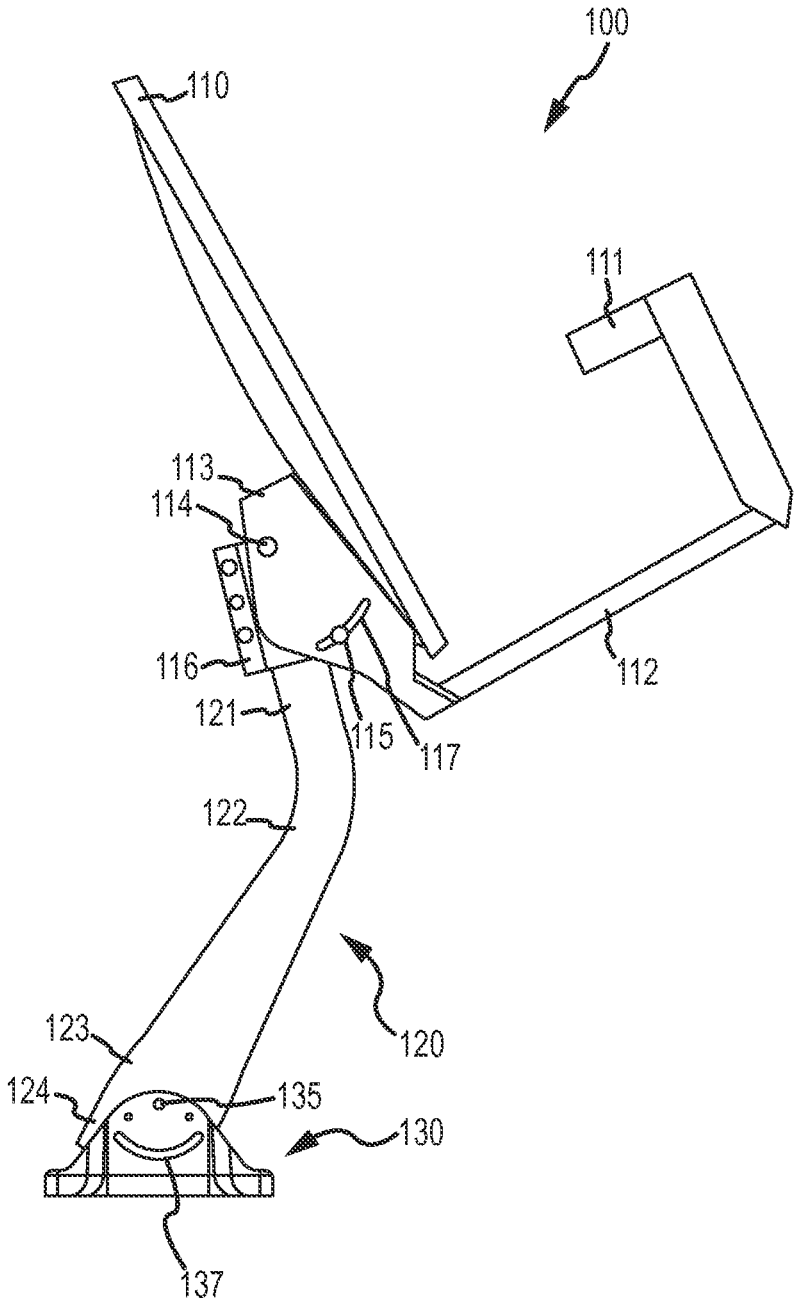
FIG. 1 is a side elevation of a satellite dish, nonconductive mast, and nonconductive foot.

FIG. 1 is a side elevation of a satellite dish, nonconductive mast, and nonconductive foot. A satellite dish assembly 100 comprises parabolic reflector 110 and low noise amplifier/block converter (LNB) 111 mounted forwardly of reflector 110 on a mounting bar 112. Typically, a coaxial cable (not shown) is connected to LNB 111 and runs through mounting bar 112 to a receiver (not shown). Reflector 110 and mounting bar 112 are fixed to a mounting bracket 113. Mounting bracket 113 includes pivot pin 114, pivot pin hole (not shown), slot pin 115, arc slot 117, and sleeve 116.

A substantially nonconductive mast 120 includes a dish end section 121, an elbow section 122, a tapered section 123, and a foot end section 124. The dish end section 121 is configured to have a circular cross-section of a diameter that corresponds to the inner diameter of sleeve 116. Thus, when sleeve 116 is loose, satellite dish assembly 100 may be rotated around dish end section 121. Mounting bracket 113 may be pivotally rotated about pivot pin 114 to orient reflector 110 with respect to dish end section 121. The angle of reflector 110 with respect to dish end section 121 may be secured by slot pin 115. Thus, if the longitudinal direction of dish end section 121 is oriented substantially vertical, reflector 110 may be rotated about dish end section 121 of mast 120 and tilted relative to mast 120 in order to point satellite dish assembly 100 at a desired location (or satellite) in the sky.

Mast 120 is mounted to a foot 130 for pivotal movement. This pivotal movement allows dish end section 121 of mast 120 to be oriented substantially vertical. Mast 120 is mounted to foot 130 for pivotal movement about pivot pin (not shown) that is disposed through pivot pin hole 135 and the angle is secured by a fastener that is disposed through arc slot 137.

Figure 2:
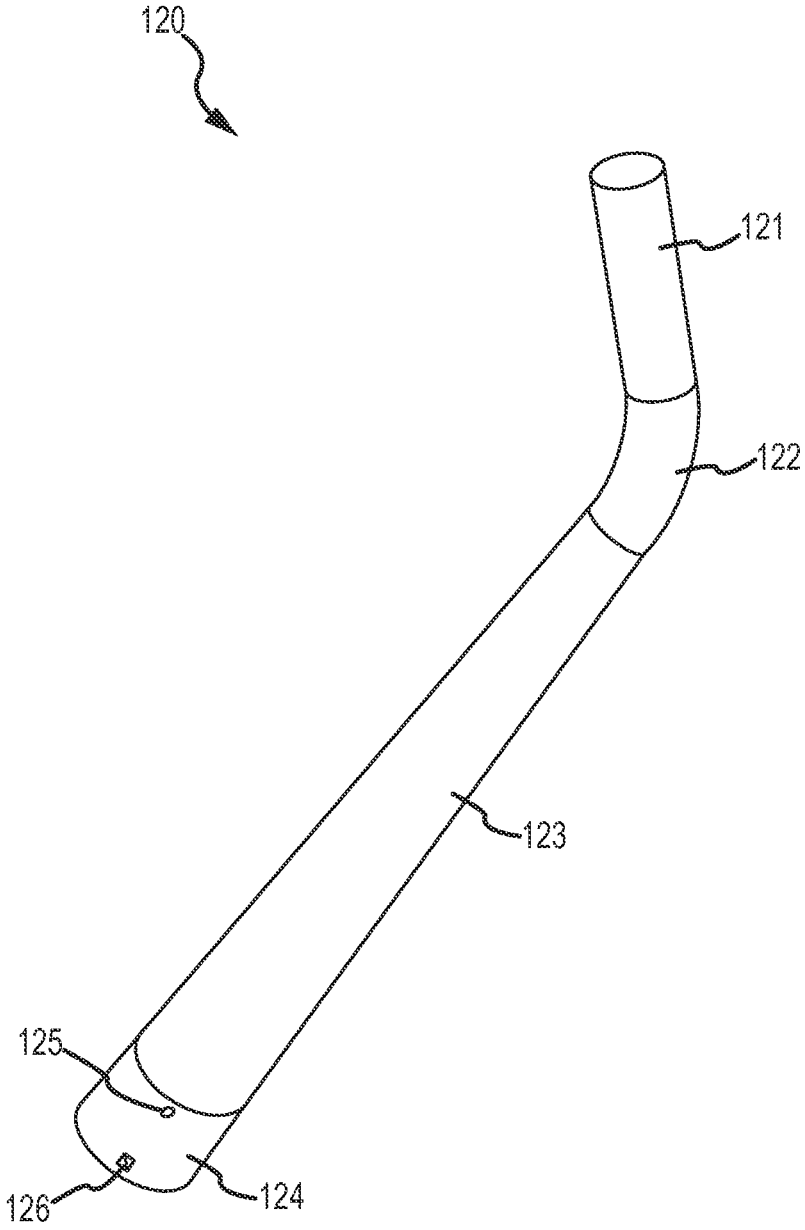
FIG. 2 is a perspective view of a nonconductive antenna mast.

FIG. 2 is a perspective view of a nonconductive antenna mast. In FIG. 2, mast 120 includes dish end section 121, elbow section 122, tapered section 123, and foot end section 124. Foot end section 124 includes pivot pin hole 125 and fastener hole 126. Foot end section 124 is configured to be securely attached to foot 130. This attachment may be by means of first and second fasteners that are disposed through at least one part of foot 130, and pivot pin hole 125 and fastener hole 126.

In an embodiment, one or more of dish end section 121, elbow section 122, tapered section 123, and foot end section 124 may be constructed substantially free of electrically conductive elements. For example, one or more parts of mast 120 may be fabricated from a nonconductive or dielectric type material. Examples of nonconductive materials that may be used to fabricate one or more (or all) of the parts of mast 120 include, but are not limited to: glass-fiber composite, fiberglass, injection-mold resin, and thermoforming materials. A glass-fiber composite is typically several layers of a resin with a glass-fiber weave forming a laminate material that can be heated, rolled, and formed to make mast 120 or its parts.

In an embodiment, dish end section 121 has a circular cross-section. The circular cross-section may have a tubular composition having both an inner and outer diameter formed by the thickness of tube wall. The circular cross-section may be solid. Thus, sleeve 116 may have a circular interior cross-section in order to receive dish end section 121. In an embodiment, dish end section 121, elbow section 122, tapered section 123, and foot end section 124 all have circular cross-sections. In an embodiment, one or more of dish end section 121, elbow section 122, tapered section 123, and foot end section 124 may have non-circular cross-sections.

Foot end section 124 may have a circular cross-section. The circular cross-section may have a tubular composition having both an inner and outer diameter formed by the thickness of a tube wall. The circular cross-section may be solid. The outer diameter of foot end section 124 may roughly correspond to the width of channel 134. This diameter may not correspond to the diameter of dish end section 121.

In an embodiment, the diameter of tapered section 123 may transition from a first diameter where tapered section 123 meets with foot end section 124 to a second diameter where tapered section 123 meets with elbow section 122. In another embodiment, elbow section 122 may transition from a first diameter where elbow section 122 meets with tapered section 123 to a second diameter where elbow section 122 meets with dish end section 121. In another embodiment, the diameter of tapered section 123 may transition from a first diameter where tapered section 123 meets with foot end section 124 to a second diameter where tapered section 123 meets with elbow section 122 and elbow section 122 may transition from this second diameter where elbow section 122 meets with tapered section 123 to a third diameter where elbow section 122 meets with dish end section 121.

Foot end section 124 and/or tapered section 123 may have a non-circular cross-section. In an embodiment, tapered section 123 may transition the non-circular cross-section to a circular cross-section with a desired diameter. This transition may be abrupt or gradual. For example, a rectangular cross-section may be gradually transitioned to a circular cross-section along the length of tapered section 123. In another example, both foot end section 124 and tapered section 123 may have non-circular cross-sections and elbow section 122 may transition a non-circular cross-section to a circular cross-section. This transition may be abrupt or gradual.

Figure 3:
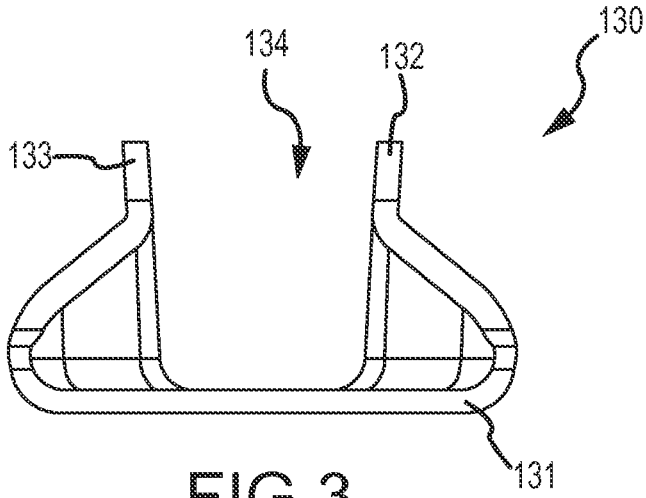
FIG. 3 is a first elevation of a nonconductive antenna mounting foot.
Figure 4:
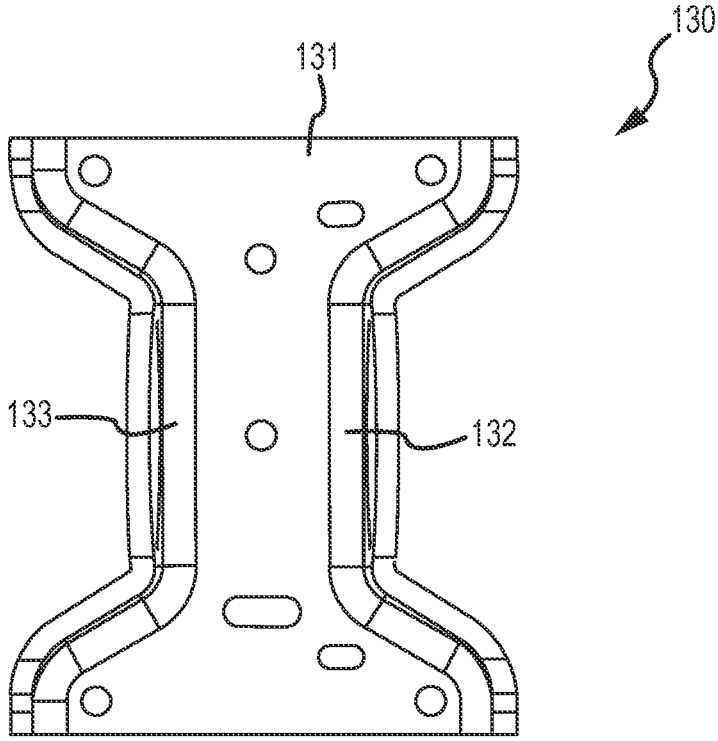
FIG. 4 is a second elevation of a nonconductive antenna mounting foot.
Figure 5:
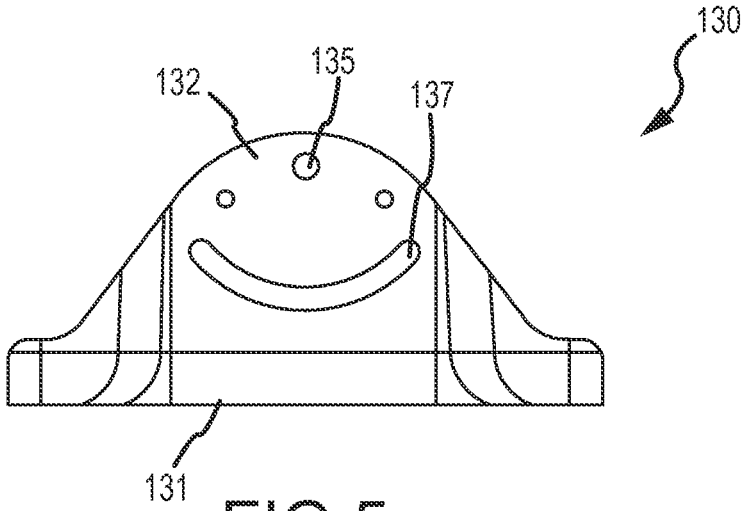
FIG. 5 is a side elevation of a nonconductive antenna mounting foot.
Figure 6:
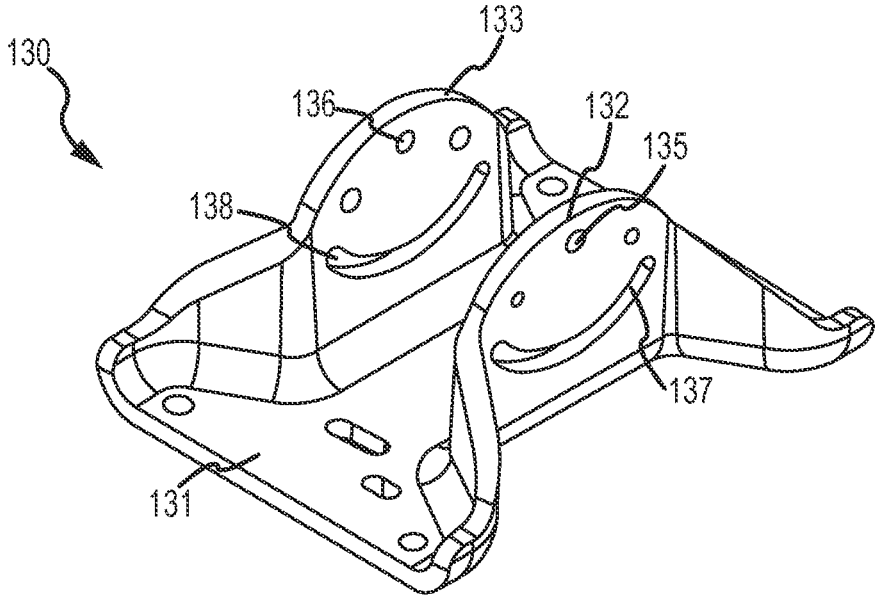
FIG. 6 is perspective view of a nonconductive antenna mounting foot.

FIGS. 3-5 are elevations of a nonconductive antenna mounting foot. FIG. 6 is perspective view of a nonconductive antenna mounting foot. In FIGS. 3-6, foot 130 comprises planar section 131, flanges 132 and 133 forming channel 134, pivot pin holes 135 and 136, and arc slots 137 and 138. Flanges 132 and 133 are connected to, and oriented substantially perpendicular to, planar section 131 and parallel to each other so as to form channel 134. In the elevation shown in FIG. 4, planar section 131 is shown to have an hourglass shape with flanges 132-133 forming the narrow portion of the hourglass. Planar section 131 is adapted to be secured to a stationary mounting surface. Various holes in planar section 131 may provide locations for screws, bolts, or other fasteners that may be used to secure foot 130 to a stationary mounting surface.

Channel 134 is adapted to receive foot end section 124. Flanges 132-133, holes 135-136, and hole 125 are adapted to have a first fastener or pivot pin disposed through them to secure mast 120 to foot 130 and provide a pivot point for mast 120. Flanges 132-133, arc slots 137-138, and fastener hole 126 are adapted to have a second fastener disposed through them to secure mast 120 to foot 130 and to secure mast 120 at a particular pivot position. Examples of fasteners that may be disposed through flanges 132-133 to secure mast 120 include screws, bolts, rivets, and pins. These fasteners may be made of conductive material such as a metal. In an embodiment, foot 120 and/or mast 130 is not made substantially conductive by the use of conductive fasteners to secure mast 120 to foot 130 and/or the use of conductive fasteners to secure mast 120 to satellite dish assembly 100.

In an embodiment, foot 130 may be constructed substantially free of electrically conductive elements. For example, foot 130 may be fabricated from a nonconductive or dielectric type material. Examples of nonconductive materials that may be used to fabricate foot 130 include, but are not limited to: glass-fiber composite, fiberglass, injection-mold resin, and thermoforming materials.

Because one or more parts of mast 120 and foot 130 are substantially free of electrically conductive elements, satellite dish assembly 100 may not need to be grounded by way of a large ground wire driven several feet into the earth. Thus, in multi-dwelling units, such as an apartment building, where installing such grounding is problematic, nonconductive mast 120 and foot 130 may provide a solution. In this situation, a grounding block may be installed on the signal wire and near the signal wires entrance to a building to bleed off static charge.

While several embodiments of the invention have been discussed herein, other implementations encompassed by the scope of the invention are possible. For example, mast 120 or foot 130 may be constructed from dielectric type materials, or combinations of materials not specifically listed previously. In addition, aspects of one embodiment disclosed herein may be combined with those of alternative embodiments to create further implementations of the present invention. Thus, while the present invention has been described in the context of specific embodiments, such descriptions are provided for illustration and not limitation. Accordingly, the proper scope of the present invention is delimited only by the following claims and their equivalents.

What is claimed is:

1. A satellite dish mount system, comprising:

a mast comprised of substantially nonconductive elements, with a first end of the mast having a circular cross-section configured to be received by a mounting bracket of a satellite dish having a circular interior cross-section;

a foot comprised of substantially nonconductive elements, the foot being configured to be secured to a stationary mounting surface and to be pivotally attached to a second end of the mast;

a satellite dish assembly mounted to the mast, the satellite dish assembly comprising a parabolic reflector and a low noise amplifier/block converter;

a signal wire coupled to the low noise amplifier/block converter; and a grounding block installed on the signal wire, wherein the grounding block is grounded, and wherein the grounding block provides grounding for the satellite dish mount system.

2. The satellite dish mount system of claim 1, wherein the second end of the mast has a circular cross-section.

3. The satellite dish mount system of claim 2, wherein the first end of the mast has a circular cross-section of a first diameter and the second end of the mast has a circular cross-section of a second diameter, the second diameter being greater than the first diameter.

4. The satellite dish mount system of claim 3, wherein the mast further comprises a tapered section transitioning the cross-section of the first diameter to the cross-section of the second diameter.

5. The satellite dish mount system of claim 4, wherein the mast further comprises an elbow section, the elbow section being disposed between the tapered section and the first end and having a circular cross-section of the first diameter.

6. The satellite dish mount system of claim 1, further comprising at least a first bolt made of a conductive material for pivotally attaching the mast to the foot.

7. The satellite dish mount system of claim 1, wherein the mast comprises glass-fiber composite.

8. The satellite dish mount system of claim 1, wherein the foot comprises glassfiber composite.

9. A method of mounting a satellite dish, comprising:

securing a mounting foot comprised of substantially nonconductive elements to a stationary mounting surface;

pivotally attaching a mast comprised of substantially nonconductive elements to the mounting foot, the mast having a tubular shape with a first end section having a first diameter, the first end section configured to be received by a mounting bracket of the satellite dish, the mounting bracket having a circular interior cross- section;

attaching a satellite dish assembly to the mast, the satellite dish assembly comprising a parabolic reflector and a low noise amplifier/block converter;

coupling a signal wire to the low noise amplifier/block converter;

installing a grounding block on the signal wire; and grounding the grounding block.

10. The method of claim 9, wherein the tubular shape of the mast comprises a tapered section.

11. The method of claim 10, wherein the tubular shape of the mast further comprises an elbow section, the elbow section being disposed between the first end section and the tapered section.

12. The method of claim 10, further comprising:

aligning the first end section of the mast into a substantially vertical position.

13. The method of claim 9, wherein the mast comprises glass fiber composite.

14. The method of claim 9, wherein the foot comprises glass fiber composite.

15. An antenna mount, comprising:

a mast comprising a first end section and a second end section, the second end section comprising substantially nonconductive parts, the first end section being adapted to be received by a mounting bracket of a satellite dish assembly comprising an antenna and a low noise amplifier/block converter coupled to a coaxial cable, the mounting bracket of the antenna allowing the antenna to be secured at a plurality of angular positions about the first end section;

a nonconductive foot comprising a planar section, a first flange, and a second flange, the planar section adapted to be secured to a mounting surface, the first flange and the second flange each having a slot, the first flange, the second flange, and the planar section forming a channel adapted to receive the second end section; and a first fastener disposed through a first hole in the first flange, the second end section, and a second hole in the second flange; and, a second fastener disposed through the slot of the first flange, the second end section, and the slot of the second flange such that when the second fastener is loose the mast may be rotated about the first fastener, wherein grounding is provided at a grounding block installed on the coaxial cable coupled to the low noise amplifier/block converter.

16. The antenna mount of claim 15, further comprising a tapered section disposed between the first end section and the second end section, the tapered section tapering from a cross-section having a first area near the second end section to a cross-section having a second area, the tapered section comprising substantially nonconductive parts.

17. The antenna mount of claim 16, further comprising an elbow section disposed between the first end section and the tapered section.

18. The antenna mount of claim 16, wherein the tapered section has a circular cross-section near the second end section.

19. The antenna mount of claim 17, wherein the elbow section comprises substantially nonconductive parts.

20. The antenna mount of claim 15, wherein the first fastener and the second fastener comprise at least one metallic bolt.

* * * * *